United States Patent [19]

Hanaoka

[11] 3,954,055

[45] May 4, 1976

[54] PARALLEL PRINTER

[75] Inventor: Seiji Hanaoka, Shiojiri, Japan

[73] Assignee: Kabushiki Kaisha Suwa Seikosha, Tokyo, Japan

[22] Filed: June 12, 1974

[21] Appl. No.: 478,675

[30] Foreign Application Priority Data

June 12, 1973 Japan ..... 48-65426

[52] U.S. Cl. ..... 101/99; 101/95; 101/93.22

[51] Int. Cl.[2] ..... B41J 1/44

[58] Field of Search 101/93.21, 93.22, 93.37–93.46, 101/95, 99, 110, 93.28–93.31

[56] References Cited

UNITED STATES PATENTS

| | | | |
|---|---|---|---|
| 3,215,070 | 11/1965 | Abernathy et al. | 101/95 |
| 3,669,016 | 6/1972 | Kittel | 101/110 X |
| 3,690,249 | 9/1972 | Nihira | 101/95 |
| 3,738,264 | 6/1973 | Sobottka et al. | 101/99 |
| 3,741,112 | 6/1973 | Cayla | 101/93.21 |
| 3,807,301 | 8/1974 | Decker | 110/110 |

*Primary Examiner*—Edgar S. Burr
*Assistant Examiner*—Edward M. Coven
*Attorney, Agent, or Firm*—Blum, Moscovitz, Friedman & Kaplan

[57] ABSTRACT

A parallel printer including an improved reset mechanism for resetting a ratchet and pawl mechanism after printing, is provided. An axially rotatable shaft having notched portions associated with each pawl effects a pivoting of each pawl out of engagement with the corresponding ratchet wheel and returns each pawl to a rest position to complete a printing cycle.

12 Claims, 3 Drawing Figures

PARALLEL PRINTER

BACKGROUND OF THE INVENTION

This invention is directed to a parallel printer and in particular to an improved reset mechanism for disengaging a pawl from a ratchet wheel positioning a print ring, to complete a printing cycle. While the use of ratchet and pawl mechanisms for positioning each printing ring in a printing position in a parallel printer is well known, mechanisms for disengaging the pawl from the ratchet wheel have taken on various forms. Such mechanisms have required extremely accurate and precise mechanisms wherein the cost for maintaining such accuracy is high and the operation of the printer due to the failure to achieve such precision has been less than completely satisfactory.

SUMMARY OF THE INVENTION

Generally speaking, in accordance with the invention, a parallel printer having an improved reset mechanism for disengaging a pawl from a ratchet wheel utilized for selectively positioning a printing ring in a print position is provided. Each printing ring has a ratchet wheel mounted thereto and is adapted to be rotated in a first rotational direction from a rest position to a print position, each of the ratchet wheels including teeth circumferentially aligned to correspond with a selected print position of the print ring. A pawl is associated with each printing ring, each pawl being mounted to pivot between a rest position and a print position to selectively engage one of the ratchet teeth on the printing ring during rotation of same in said first rotational direction to thereby position the print ring for printing. A reset mechanism returns the pawls from a print position to a rest position. The reset mechanism includes an axially rotatable shaft having a notched portion associated with each pawl, rotation of the shaft effecting a pivoting of the pawls to a rest position to complete the print cycle.

Accordingly, it is an object of this invention to provide an improved parallel printer wherein the resetting mechanism is simplified.

It is still another object of this invention to provide an improved and more reliable parallel printer.

It is still a further object of this invention to provide an inexpensive parallel printer wherein the cost thereof is reduced by the reduction in the number of parts of the reset mechanism.

Still other objects and advantages of the invention will in part be obvious and will in part be apparent from the specification.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
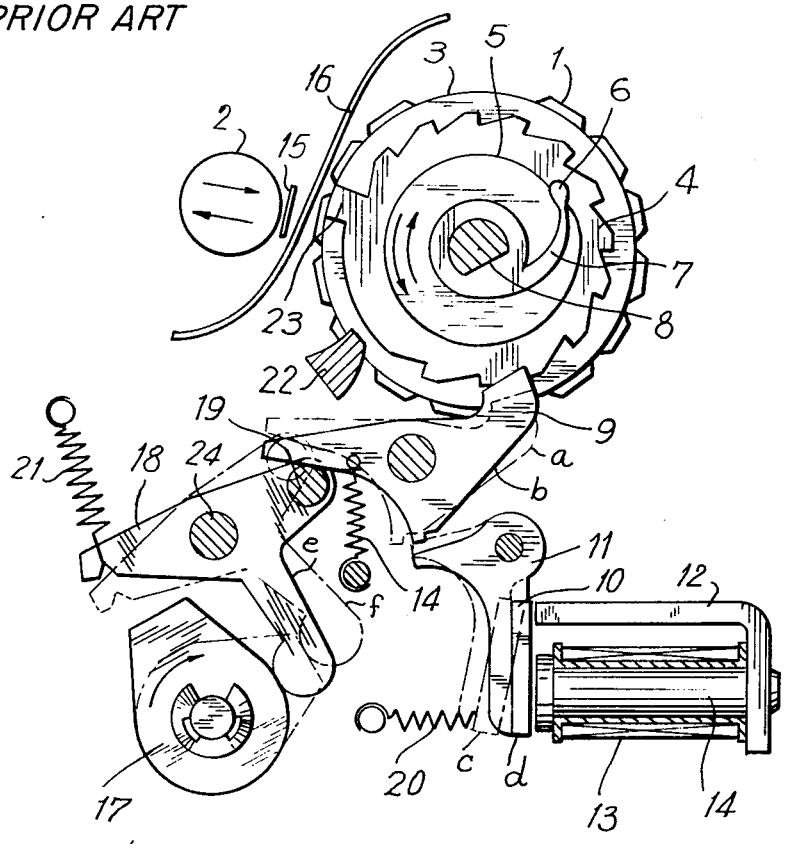
FIG. 1 PRIOR ART
FIG. 1 is an elevated partially sectioned view of a conventional parallel printer constructed in accordance with the prior art.

Referring to FIG. 1, a parallel printer constructed in accordance with the prior art is depicted. The printer includes a plurality of print characters 1 circumferentially disposed on each character ring 3. Each character ring 3 is disposed on a character ring shaft 8, the stopping, and direction of rotation of the character rings 3 being determined by the character ring shaft. A ratchet wheel 4 having a plurality of teeth disposed thereon is mounted to the side of each character ring 3, the print characters 1 on the character rings 3 being aligned with the ratchet wheel teeth to provide a positioning of the print characters in a manner to be hereinafter discussed. A recess 6 is defined by the inner peripheral surface 5 of the ratchet wheels. Spring members 7 having a first end disposed in the recess 6 formed in the ratchet wheel is further fitted at the other end thereof over the character ring shaft 8.

At the beginning of a printing operation, a pawl 9 remains at a rest position as indicated by broken line a. At the rest position, the pawl 9 engages a pivotable lever 11 which is depicted in a rest position by broken line *c*. An attracting plate 10 is disposed on lever 11, which lever is maintained in a rest position by a spring 20. During the character selection phase of the print cycle, the print characters on the print rings are selectively rotatably positioned by the resilience in the spring member 7 which results in the synchronous rotation of the character ring shaft 8 and character ring 3 in a first rotational direction, indicated as clockwise in FIG. 1. When a print character 1 to be selected is positioned in facing relationship with a platen 2, a selectively applied control signal is applied to a coil 13 which is part of an electromagnet 12, the electromagnetic field generated thereby effecting a magnetic flux field in iron core 14 which attracts the attracting plate 10 secured to lever 11. The force of the electromagnet attraction overcomes the force of spring 20 on lever 11 and effects a counter-clockwise pivoting of the lever 11 to a print position, as indicated by solid line *d* in FIG. 1. The pivoting of the lever 11 out of contact with the pawl 9 causes the pawl to be pivoted in a counter clockwise direction by the force of spring 14 thereon into a print position indicated by solid line *b*, the pawl thereby engaging a tooth on the ratchet wheel and stopping the rotation of the character ring 3. The character ring shaft continues to rotate through a completed revolution in order to allow each of print wheels to be positioned. During the rotation of the character ring shaft the tip end of the spring 7 is disengaged from the recess 6 and slides on the inner peripheral surface thereof until the character ring shaft completes its rotation.

Upon the selective positioning of each of the character rings in facing relationship with the platen 2, and upon stopping the rotation of the character ring shaft 8, the printing phase of the print cycle is effected. Accordingly, the platen 2 urges printing paper 16 into contact with the print characters on the character rings and an ink supply member 15 therebetween to thereby effect a printing of the print characters on the paper.

Upon completion of the printing phase, the resetting phase begins. A cam 17 which is adapted to rotate through a complete revolution for each printing cycle effects a counter-clockwise pivoting of reset lever 18 around pivot 24 from the position indicated by solid line e to the position indicated by the broken line f. A reset bar 19 (shown only in cross-section) is secured to the reset lever 18 and is in operative contact with each of the pawls 9 to pivot each of the pawls in a clockwise direction from a print position indicated as solid line b, to the rest position indicated by broken line a. Similtaneously therewith, the electromagnetic field is terminated in the iron core 14 and the spring 20 pivots lever 11 in a clockwise direction to return same to a rest position indicated by broken line *c*. Accordingly, the pawl 9 and the lever 11 are placed in operative engagement at a rest position prior to the next character selection cycle. As the cam 17 is further rotated, the resilient force placed on reset lever 18 by spring 21 effects a return of the reset lever 18 to the position indicated by the solid line *e*. The character ring shaft 8 is then rotated in the other rotational direction (counter-clockwise), until a stopper 23 provided on the ratchet wheel comes into contact with a rest stopper 22 thereby stopping rotation of the print wheel. The spring member 7 around character ring shaft 8 is engaged in the recess 6 whereupon the rotation of the shaft is terminated, thereby completing the printing cycle.

From the foregoing detailed illustration of a conventional prallel printer, the following disadvantages are noted. The angle of oscillation of the pawl 9 between the rest position indicated by broken line a and the print position indicated by solid line b depends on several factors including the precision with which cam 17 and the reset lever 18 are designed, the precision with which the reset bar 19 is positioned when the reset bar 19 is mounted on reset lever 18, and the curvature of the reset bar 19 which often occurs during continual use thereof. Accordingly, it is difficult to provide a reset mechanism with the necessary precision, the failure to provide same resulting in the likelihood that inaccurate printing will be effected. An example of the inaccuracies caused thereby is where the cam 17 causes the reset lever 18 to return the pawl 9 to a position adjacent to the rest position. The result of the failure to pivot the pawl through a sufficient angle to place same at the rest position will prevent movement of the lever 11 into engagement with pawl 9 thereby resulting in the commencement of the next printing cycle with the pawl 9 still engaged in the ratchet wheel. Thus, the exact precision required for the operative elements in the resetting mechanism including rest bar 19, pivot 24 and mounting of reset bar 19 on the reset lever 18, render the manufacturing and assembling of same tedious and slow, thereby increasing the manufacturing costs thereof.

Figure 2:
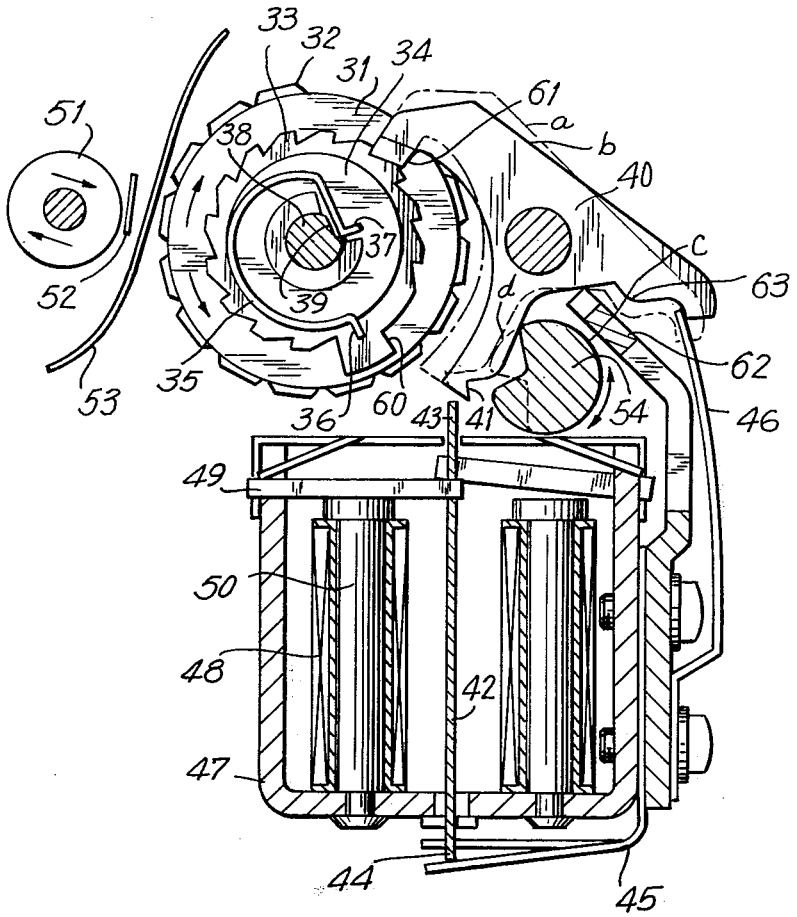
FIG. 2 is an elevated partially sectioned view of a parallel printer including a resetting mechanism constructed in accordance with the instant invention.
Figure 3:
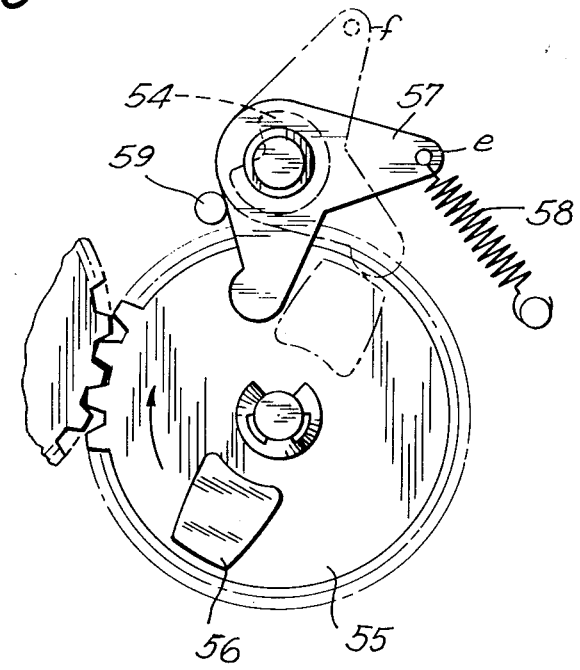
FIG. 3 is an elevated view of part of the resetting mechanism illustrated in FIG. 2.

Reference is now made to FIGS. 2 and 3 wherein the disadvantages noted above in the resetting mechanisms of prior art printers are corrected by the parallel printer depicted therein. Each character ring 31 includes print characters 32 circumferentially disposed thereon in alignment with the teeth of a ratchet wheel 33 secured to the side of the character ring 31. A spring member 35 is located within a cavity 34 formed in the ratchet wheel 33, the spring member 35 having a pair of bends 36 and 37, the first of which, 36, is secured to character ring 31 while the other bend, 37, is free standing and rests in notch 39 disposed in character ring shaft 38. As in the prior art embodiment noted above, the character ring shaft 38 is driven by a power source (not shown) and, controls the stopping and direction of rotation of the print rings.

Immediately prior to the beginning of the print cycle, a pawl 40 is disposed in a rest position, as indicated by broken line a, a tail portion 41 of pawl 40 being engaged with the tip end 43 of a trigger bar 42. A leaf spring 46 applies a constant counter-clockwise pivoting force on pawl 40, the engagement of tip end 43 of the trigger bar with tail portion 41 resisting the counter-clockwise pivoting force of leaf spring 46 to thereby prevent engagement of pawl 40 with the teeth on ratchet wheel 33. Trigger bar 42 is maintained in engagement with tail portion 41 of pawl 40 by leaf spring 44 which spring applies a resilient force against the lower end 44 of trigger bar 42 to urge same in the upward direction. Attracting plate 49 which is interlocked with trigger bar 42 is attracted toward iron core 50 when a current is applied to coil 48 of electromagnet 47 to thereby cause the trigger bar 42 to be displaced downward out of engagement with tail portion 41 of pawl 40.

During the print character positioning phase of the printing cycle, the character ring 31 is rotated in a first rotational direction, indicated as clockwise in FIG. 2, by the resiliency of spring member 35 and the synchronous rotation of the character ring shaft 38. When a print character to be printed is located in facing relationship with platen 51, a control signal is applied to coil 48, the flux field effected thereby generating a flux field in iron core 50 and causing a downward displacement of trigger bar 42 to thereby disengage the tip portion thereof from the pawl's tail portion. The pawl is thereby pivoted in a counter-clockwise direction by leaf spring 46 into engagement with the teeth on the ratchet wheel 33 to thereby stop the rotation of the character ring 31. The character ring shaft 38 continues to rotate, the bend 37 in spring member 35 being disengaged from the notch 39 in character ring shaft 38, and continues sliding on the circumference of the character ring shaft 38. When the print characters on each of the print character rings is located in facing alignment with the platen 51 and the character ring shaft 38 is rotated through a complete revolution and has come to a stop, the platen urges the printing paper 53 against the print characters 32 aligned in facing relationship therewith and an ink supply member 52 therebetween to effect printing of the print character on the paper.

During the printing phase of the printing cycle, reset shaft 54 is disposed in the position indicated by solid line *c*. Upon completion of the printing operation, a cam 56 mounted to gear 55 causes lever 57 secured to the end of resetting shaft 54 to be rotated from a first position illustrated by solid line e to a second position indicated by broken line *f* which in turn effects a rotation of resetting shaft 54 to the position indicated by broken line *d*. The rotation of resetting shaft 54 effects a clockwise pivoting of pawl 40 from its print position idicated by solid line *b* to the rest position indicated by broken line *a*. The selectively applied control signal applied to coil 48 is terminated before returning pawl 40 to its rest position, thereby removing the magnetic force on the attraction plate 49 and hence allowing leaf spring 45 to force trigger bar 42 into engagement with tail portion 41 of pawl 40. As the cam 56 continues to be rotated by gear 55, the cam passes lever 57 and spring 58 will return lever 57 into engagement with stopper pin 59. Since the pawl is removed from engagement with the teeth in ratchet wheel 33, and because shaft 54 has an arc shape portion which is at an equal distance from its center of rotation, each pawl is returned to the rest position by the engagement between the resetting shaft 54 and the pawl 40 whereupon the arc shaped portion clears the pawl thus requiring minimal precision in the assembly of the printer.

When each of the pawls have been reset to a rest position, the character ring shaft 38 begins counter-clockwise rotation until stopper 60 formed on character ring 31 comes into engagement with rest stopper 61 disposed on pawl 40, thereby effecting an end to the counter-clockwise rotation of the character ring 31. At such time, the pawl 40 tends to rotate clockwise because of the rotational energy of the character ring 31, but rotation thereof is prohibited by a pawl stopper 62 and by a projection 63 on the pawl. Thus, the character ring 38 continues to rotate until the bend 37 in spring member 3 is nested in notch 39 whereupon character ring shaft 38 stops rotating and the printing cycle is completed.

In the reset mechanism described above, the reset shaft has an arc shaped cross-section which is radially equal at all points from the center of rotation of the shaft. Since cam 56 has to rotate through a complete revolution and therefore equally displace lever 57 during each rotation thereof, each pawl is prevented from rotating in excess of a given amount, and the angle of rotation of the pawl when returning same from a print position to a rest position is only determined by the engagement of the pawl in the notch of the reset shaft. Thus, the angle of rotation of the pawl depends only on the positioning of the notch in the reset shaft and not on the precision with which cam 56 and lever 57 are formed. Thus the amount of rotation of the pawl can be accurately controlled and the tail portion of the pawl can be reliably engaged with the trigger bar to avoid the incorrect printing during the next printing cycle that occurs in the conventional parallel printers. Moreover, because an excessive rotation of pawl 40 is avoided by the instant invention, the clearance between the pawl stopper 62 and projection 63 on pawl 40 can be safely and easily provided. Moreover, it is only necessary to mount lever 57 on the resetting shaft 54 during manufacturing of same to thereby realize a resetting mechanism having reduced number of parts, with a facilitated manner of assembling such parallel printers, resulting in reduced manufacturing costs.

It will thus be seen that the objects set forth above, among those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a parallel printer comprising at least two printing rings having print characters circumferentially positioned thereon, first rotation means for rotating each said printing ring in a first rotational direction from a printing ring rest position to a printing ring print position and a ratchet wheel mounted on the side of each said printing ring, to be rotated therewith, each said ratchet wheel including ratchet teeth, each said tooth circumferentially disposed to correspond with a print position of the print ring, the improvement comprising a pawl associated with each printing ring, pivot means coupled to each said pawl to selectively pivot each of said pawls from a pawl rest position to a pawl print position to selectively engage one of said ratchet wheel teeth in each said associated printing ring to stop the rotation of said print wheel thereby positioning said print characters at a print position for printing, and reset means for returning each of said pawls from a pawl print position to a pawl rest position, said reset means including an axially rotatable reset shaft and second rotation means for rotating said rotatable reset shaft from a reset shaft rest position, said reset shaft having a notched portion therein for receiving a portion of each of said pawls when said pawls are in a pawl print position and for pivoting said pawls out of said notch and thereby to said pawl rest position in response to rotation of said reset shaft from said reset shaft rest position.

2. A parallel printer as claimed in claim 1, wherein said second rotation means for rotating said reset shaft effects rotation of said reset shaft in the same rotational direction as the direction of rotation through which said pawls are pivoted by said pivot means.

3. A parallel printer as claimed in claim 2, wherein said reset shaft is cross-sectioned to include a continuous circular arc intersected by a recessed notch therein.

4. A parallel printer as claimed in claim 3, wherein each said printing ring and ratchet means mounted thereto are adapted to be rotated in a second rotational direction by said first rotation means, each said ratchet wheel includes a stopper means and each said pawl include a projection thereon, said stopper means effecting a positioning of said printing ring in a printing ring rest position upon rotation of said printing ring in said second rotational direction after said pawl is released from engagement with said ratchet means.

5. A parallel printer as claimed in claim 4, including a trigger means, said trigger means including a trigger bar, and each said pawl including a tail, said tail being engaged by said trigger bar to maintain said pawl in a pawl rest position.

6. A parallel printer as claimed in claim 5, wherein spring biasing means are in contact with each of said pawls for pivoting same into a pawl print position upon the disengagement of said pawl by said trigger bar.

7. A parallel printer as claimed in claim 6, wherein said trigger means further includes spring biasing means for positioning said trigger bar in contact with the tail of said pawl and electromagnetic positioning means for selectively displacing said trigger bar out of contact with said tail.

8. A parallel printer as claimed in claim 3, wherein each of said pawls include a projection thereon, and a stopper means provided for each pawl, each said stopper means being selectively positioned to be engaged by said projection on each of said pawls when each said pawl is rotated toward a pawl rest position by said pivot means to thereby define said pawl rest position.

9. A parallel printer as claimed in claim 8, wherein each of said character rings and ratchet means mounted thereto are adapted to be rotated in a second rotational direction and said ratchet wheel includes a stopper means, and said pawls include a rest portion projecting therefrom, said rest portion adapted to engage said stopper means at a certain rotational position thereof to limit the rotation of said ratchet wheel and printing ring in said second rotational direction.

10. A parallel printer as claimed in claim 2, wherein said second means for rotating said reset shaft include a lever coupled to said reset shaft for rotating same, a spring means coupled to said lever for pivoting said lever in a first rotational direction, and camming means adapted to be rotated into and out of engagement with said lever, said camming means rotating said lever in a second rotational direction during engagement with said lever.

11. A parallel printer as claimed in claim 10, wherein said camming means includes a gear, a cam mounted to said gear, said cam engaging said lever and pivoting same in response to rotation of the gear.

12. A parallel printer as claimed in claim 11, wherein said spring means returns said lever to a rest position upon said cam being rotated out of engagement from said lever.

* * * * *